United States Patent [19]

Arendt et al.

[11] 4,160,708

[45] * Jul. 10, 1979

[54] COATED SILICON-IRON PRODUCT AND PROCESS THEREFOR USING CALCIUM FORMATE

[75] Inventors: Ronald H. Arendt; Matthew J. Curran, both of Schenectady, N.Y.

[73] Assignee: General Electric Company, Schenectady, N.Y.

[ * ] Notice: The portion of the term of this patent subsequent to Jun. 20, 1995, has been disclaimed.

[21] Appl. No.: 899,490

[22] Filed: Apr. 24, 1978

[51] Int. Cl.[2] ..... C25D 5/50; H01F 1/04

[52] U.S. Cl. ..... 204/37 R; 204/40; 204/56 R; 148/31.5; 148/113; 428/469; 428/633

[58] Field of Search ..... 204/37 R, 40, 56 R; 427/127, 132; 428/469, 471, 633; 148/12.1, 27, 31.5, 113, 111, 112, 122

[56] References Cited

U.S. PATENT DOCUMENTS

| | | | |
|---|---|---|---|
| 3,054,732 | 9/1962 | McQuade | 204/37 |
| 3,379,581 | 4/1968 | Kohler | 148/113 |
| 3,676,227 | 7/1972 | Matsumoto | 148/111 |
| 3,700,506 | 10/1972 | Tanaka | 148/111 |
| 3,905,842 | 9/1975 | Grenoble | 148/111 |
| 4,030,950 | 6/1977 | Shilling | 148/112 |
| 4,096,001 | 6/1978 | Arendt | 148/113 |

*Primary Examiner*—John H. Mack
*Assistant Examiner*—William Leader
*Attorney, Agent, or Firm*—Richard G. Jackson; Joseph T. Cohen; Leo I. MaLossi

[57] ABSTRACT

A relatively thin coat of calcium metaborate is electrolytically-applied from a solution of calcium formate with boric acid directly to the surface of a boron-containing electrical steel and a substantially thicker overcoat of $Mg(OH)_2$ is electrolytically-deposited on the calcium metaborate coating to provide a duplex coating about 0.2 mil thick.

9 Claims, 1 Drawing Figure

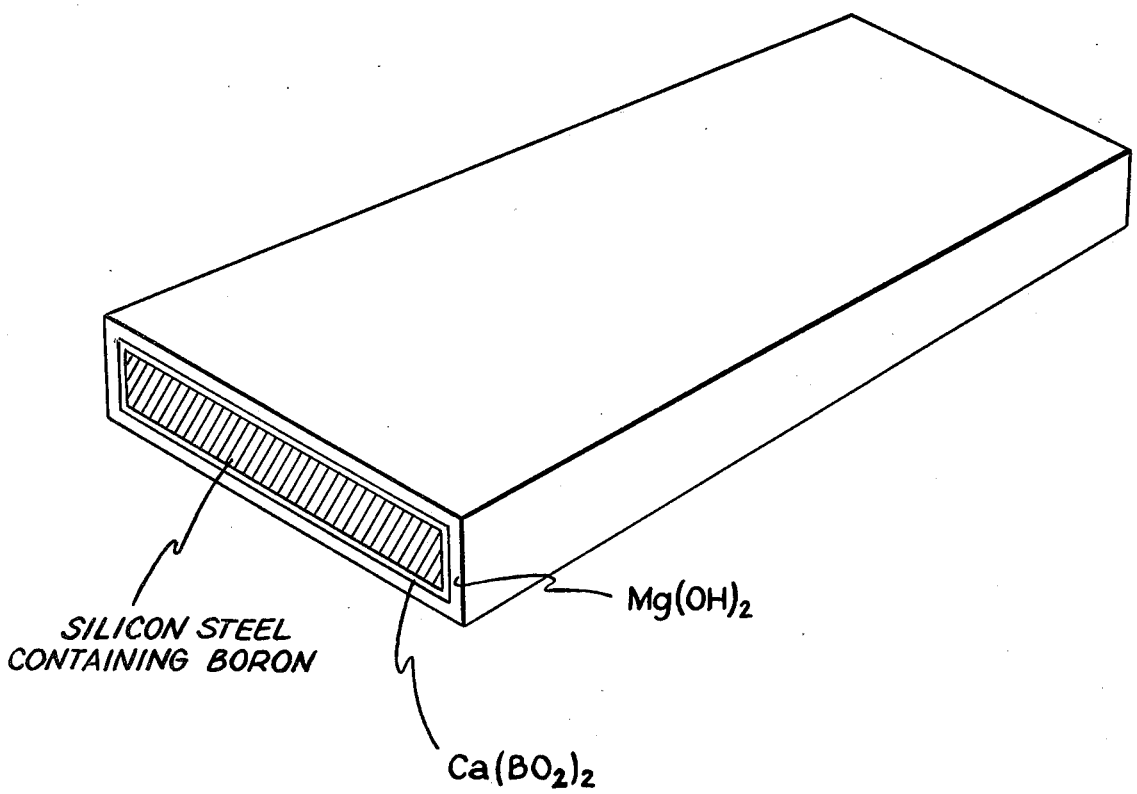
SILICON STEEL
CONTAINING BORON
$Mg(OH)_2$
$Ca(BO_2)_2$

COATED SILICON-IRON PRODUCT AND PROCESS THEREFOR USING CALCIUM FORMATE

The present invention relates generally to the art of producing electrical steel and is more particularly concerned with a novel method employing calcium formate for electrolytically depositing a boron-containing electrically-insulating coating on a boron-containing silicon-iron magnetic sheet, and with the unique coated silicon-iron product made by that method.

CROSS REFERENCES

Reference is made to copending U.S. Patent application of Ronald H. Arendt and Patrick F. Aubourg, Ser. No. 774,808 (now U.S. Pat. No. 4,116,730), filed Mar. 7, 1977, entitled "Silicon-Iron Production and Composition and Process Therefor." That application is directed to a method of producing grain-oriented silicon-iron sheet wherein a boron-containing electrically-insulating coating is deposited on a boron-containing silicon-iron magnetic sheet from an aqueous solution including magnesia, magnesium metaborate and magnesium acetate. Reference is also made to our copending U.S. Patent application Ser. No. 774,807 (now U.S. Pat. No. 4,097,343—issued June 27, 1978), filed Mar. 7, 1977, entitled "Coated Silicon-Iron Product and Process Therefor," and directed to the novel concept of providing a "duplex" refractory electrically-insulating coating of a primary layer of an electrolytically-deposited layer of a boron-containing magnesia. Reference is also made to our copending U.S. Patent application Ser. No. 774,806 (now U.S. Pat. No. 4,096,001—issued June 20, 1978), filed Mar. 7, 1977, entitled, "Coated Silicon-Iron Product and Process Therefor" and directed to the novel concept of providing a calcium metaborate coating on silicon-iron sheet or strip material by an electrolytic deposition process. The foregoing applications are assigned to the assignee hereof and incorporated herein by reference.

BACKGROUND OF THE INVENTION

Following the discovery by Grenoble (U.S. Pat. No. 3,905,842 granted Sept. 16, 1975 and assigned to the assignee hereof) that boron is effective in small but critical amount and in critical proportion to nitrogen in silicon-iron to promote secondary recrystallization during the final texture-developing anneal, Maucione (U.S. Patent application Ser. No. 677,147, filed Apr. 15, 1976 and also assigned to the assignee hereof) found that the presence of a very small amount of boron in the coating on such a boron-containing steel further promotes secondary recrystallization and development of still better magnetic properties in the ultimate product. Maucione further found that the presence of boron in the coating can cause secondary recrystallization to take place when it otherwise would not, and also discovered that the presence of boron in the insulating coating was not effective in causing or promoting secondary recrystallization in the absence of boron in the metal itself at the outset of the final anneal.

In the practice of Maucione's teachings, boron has been incorporated in the refractory oxide coating, usually magnesium hydroxide [$Mg(OH)_2$], provided in accordance with the process disclosed and claimed by McQuade in U.S. Pat. No. 3,054,732 by a dipping operation or by brushing a solution of a suitable boron compound on the coating, or even spraying it on.

Then, through the discovery by Arendt and Aubourg that a boron-containing compound and $Mg(OH)_2$ can be electrolytically codeposited as described and claimed in their patent application referred to above, it became possible to exercise better control over the amount of boron incorporated in the insulating coating and also to more uniformly distribute the boron throughout the coating. As another important advantage of this codeposition method, the resulting product has a surface which is more amenable to fabrication operations customarily involved in the use of electrical steel.

SUMMARY OF THE INVENTION

In accordance with our discoveries to be described, it is possible to enhance substantially the beneficial effect on the ultimate sheet product of boron in the coating without losing the foregoing advantages of the Maucione and the Arendt ad Aubourg inventions. In particular, we have found that a coating of calcium metaborate [$Ca(BO_2)_2$] can be applied electrolytically through the use of a homogeneous solution of calcium formate and boric acid buffered with solid $Ca(BO_2)_2$ at a temperature of at least about 65° C. and preferably about 95° C. Further, we have found that $Ca(BO_2)_2$ in coating form is effective to prevent egress of boron from the silicon-iron sheet during the final anneal and that by providing a coating of $Mg(OH)_2$ over the $Ca(BO_2)_2$ coating it is possible to retain the boron in place in proximity to the sheet surface during the critical early stages of the final anneal even though the overcoating itself contains little or no boron at all. Thus, the boron essential to the secondary recrystallization of the silicon-iron during the texture-developing anneal is retained in the metal without incurring the offsetting disadvantages of having either a coating which is not thick enough to provide the insulating property required or a coating which contains a total quantity of boron which is detrimental to the magnetic properties of the ultimate silicon-iron sheet product.

We have discovered in addition that the primary coating of this invention serves effectively to getter sulfur in the silicon-iron substrate to further enhance the magnetic properties of the ultimate sheet material.

Still further, we have found that satisfactory coatings and the new advantages of this invention can be consistently produced and obtained only if the temperature of each electrolyte is maintained throughout its deposition operation at 65° C. or higher and preferably about 90°–95° C.

This invention has both method and article or product aspects, the method centering in the novel feature of sequential $Ca(BO_2)_2$ and $Mg(OH)_2$ electrolytic deposition. The product is the $Mg(OH)_2$-and $Ca(BO_2)_2$-coated boron-containing silicon-iron body produced by the sequential deposition process of this invention.

Surprisingly and advantageously, we have now found that, by the practice of this invention, replacement of calcium acetate in whole or in part with calcium formate in the method described in our above-referenced patent application Ser. No. 774,806 (Now U.S. Pat. No. 4,096,001) will significantly decrease the extent of carburization of the coated silicon-iron body which is effected during the final or texture-developing anneal. Maximum such decrease is effected at total replacement with calcium formate, whereupon the extent of carburization (i.e., the percent increase in carbide content) will generally be not more than 40 percent (and typically not more than 20 percent) of the extent of carburization which would be observed under the same conditions except employing an amount of calcium acetate which is equimolar with respect to the amount of calcium formate employed. Notwithstanding that formate and acetate groups are homologs in the series of acylate groups, this discovered advantage of decreased carburization extent could not have been predicted since, as will be apparent to those skilled in the art, the formate group is the lowest member of the acylate series and the chemical behavior of such lowest members can not be reliably predicted from the chemical behavior of higher members in homolog series with respect to complex chemical phenomena, e.g., carburization.

Unexpectedly, it has now further been found by practice of this invention that use of calcium formate results in deposition of calcium metaborate to form a coating which is both at least as uniform and at least as strongly adherent to the silicon-iron substrate as the corresponding coating obtained using calcium acetate. Comparison of the $K_a$ of about $1.8\times10^{-4}$ for formic acid with the $K_a$ of about $1.8\times10^{-5}$ for acetic acid would lead one of ordinary skill in the art to anticipate that, if a deposited coating could be made from the approximately ten-fold acidic formate, such coating would be poorly adherent and of non-uniform character, e.g., an outwardly concave lenticular coating.

A further unexpected aspect of this invention is that deposition employing the formate can be effected in a manner which is at least as energy-efficient as can be obtained employing the acetate. That is, coating density obtained at the same electrolyzing energy is generally at least as high for the formate as for the acetate.

Briefly described, then, the new method of this invention comprises the steps of providing a boron-containing electrical steel, electrolyzing a $Ca(BO_2)_2$-buffered aqueous electrolytic solution of calcium formate and boric acid of pH less than 7.0 with the silicon-iron sheet material being arranged as the cathode in the solution and with the solution being at a temperature of at least about 65° C. and thereby covering the sheet with an adherent, relatively thin, electrically-insulating coating of $Ca(BO_2)_2$, then with the resulting coated sheet arranged as the cathode in an aqueous electrolytic solution consisting essentially of magnesium formate buffered with solid MgO electrolytically depositing a substantially thicker coating of $Mg(OH)_2$ on the said coated sheet, and thereafter subjecting the resulting double-coated sheet to a final heat treatment to develop (110)[001] secondary recrystallization texture in the silicon-iron sheet.

Similarly described, the article of this invention is the duplex-coated, primary recrystallized, boron-containing silicon-iron sheet product of the sequential deposition steps of the process of this invention.

DETAILED DESCRIPTION OF THE INVENTION

As illustrated by the drawing accompanying and forming a part of this specification, this invention is carried out using a boron-containing electrical steel sheet substrate and applying thereto a substantially uniform, relatively thin coating of $Ca(BO_2)_2$ and then applying a $Mg(OH)_2$ coating of somewhat greater thickness to the resulting coated sheet material. As the initial step in the process, the substrate metal sheet is provided by preparing a silicon-iron melt of the required chemistry and then casting and hot rolling to intermediate thickness. Thus, the melt on pouring will contain from 2.2 to 4.5 percent silicon, manganese and sulfur in amounts in a ratio of manganese to sulfur less than 2.3, from about three to 50 parts per million boron and about 15 to 95 ppm nitrogen in the ratio range to boron of one and 15 parts to one, the remainder being iron and small amounts of incidental impurities including carbon, aluminum, copper and oxygen. Following anneal, the hot band is cold rolled with or without intermediate anneal to final gauge thickness and then decarburized.

The resulting fine-grained, primary-recrystallized, silicon-iron sheet material in whatever manner produced is processed to provide the essential boron-containing coating of this invention in preparation for the final texture-developing anneal. Processing at this point involves the critical use of the applicants' present discoveries and this inventive process of electrolytically depositing an initial coating of $Ca(BO_2)_2$ and then a secondary and somewhat heavier or thicker coating of $Mg(OH)_2$. With the sheet material connected as a cathode and the circuit as described in the above-referenced U.S. Pat. No. 3,054,732 and immersed in an electrolyte of calcium formate and boric acid buffered with solid $Ca(BO_2)_2$, a coating of $Ca(BO_2)_2$ of substantially uniform thickness is formed over the entire surface of the sheet in contact with the electrolyte. A coating of $Mg(OH)_2$ is similarly electrolytically deposited over the $Ca(BO_2)_2$ coating to a total thickness between about 0.10 and 0.40 mil, the $Ca(BO_2)_2$ initial coat being the thinner of the two at between about 0.02 and 0.07 mil.

As the final step of the process of this invention, the double- or duplex-coated sheet is heated in hydrogen or a mixture of nitrogen and hydrogen to cause secondary grain growth which begins at about 950° C. As the temperature is raised at about 50° C. per hour to 1000° C., the recrystallization process is completed and heating may be carried on to up to 1175° C. if desired to insure complete removal of residual carbon, sulfur and nitrogen.

The following illustrative, but not limiting, examples of our novel process as actually carried out with the new results indicated above will further inform those skilled in the art of the nature and special utility of this invention:

EXAMPLE I

Eleven-mil strips of silicon-iron of the following composition were prepared as described in U.S. Pat. No. 3,905,842 (Grenoble) referred to above:

Carbon: 0.030%
Manganese: 0.035%
Sulfur: 0.031%
Boron: 0.0010%
Nitrogen: 0.0050% Copper: 0.24% Aluminum; 0.005% Iron: Remainder From this melt composition, 10.7 mil sheets were produced in a series of hot rolling passes followed by pickling and annealing of the intermediate thickness sheet material (about 100 mils) and cold rolling to 60 mils thickness, whereupon the material was reheated and cold rolled again to final thickness and the cold-worked sheet was given a decarburizing heat treatment at 800° C. for eight minutes in hydrogen (room temperature dew point).

Epstein strips cut from the sheet to provide five Epstein packs were immersed in an electrolyte prepared by adding boric acid and $Ca(BO_2)_2$ to a 10% aqueous solution of calcium formate in distilled water. Sufficient boric acid was added to the solution to raise the pH to about 7.0.

The strips were made cathodes in electric circuits, eight volts being applied across the terminals at a current density of 90 amperes per square foot for varying lengths of time to provide $Ca(Bo_2)_2$ coatings of the thicknesses set forth in Table 1. On removal of the strips from the primary coating electrolytes, they were placed in magnesium electrolytes as described in U.S. Pat. No. 3,054,732 (except that the magnesium salt employed in preparing the electrolytes was magnesium formate), the coated strips again being cathodes in electric circuits and eight volts again being applied across the terminals until the coating mass of $Mg(OH)_2$ deposited on the strips was as also indicated in Table I.

After annealing in hydrogen for about eight hours at 1175° C., the duplex-coated strips had the magnetic properties stated in Table I.

TABLE 1

| | | Losses, mwpp | | Coating Densities (mg/strip) | |
|---|---|---|---|---|---|
| Pack | u10 Oe | 15 kG | 17 kG | $Ca(BO_2)_2$ | $Mg(OH)_2$ |
| 1 | 1890 | 489 | 632 | 6.1 | 72.2 |
| 2 | 1887 | 498 | 651 | 8.8 | 92.7 |
| 3 | 1885 | 505 | 660 | 9.6 | 62.8 |
| 4 | 1886 | 501 | 649 | 9.8 | 62.0 |
| 5 | 1890 | 489 | 629 | 12.0 | 60.4 |

NOTE:
All values are approximate.

As is apparent from comparison of these data with those set out in Tables I and II of copending patent application Ser. No. 774,806, filed Mar. 7, 1977, the above-tabulated results obtained through the process of the present invention are generally the same as those obtained through the use of the $Mg(OH)_2$—$Mg(BO_2)_2$ duplex coating method of the invention of that companion case of ours.

Those skilled in the art will recognize that coating weight or thickness is commonly expressed in terms of density in ounces per square foot of steel strip surface and that 0.0275 $oz/ft^2$=77 milligrams per Epstein strip. Further, it is generally understood that 77 mg/Epstein strip corresponds to uniform coating thickness of 0.05 mil.

What we claim as new and desire to secure by Letters Patent of the United States is:

1. The method of producing grain-oriented silicon-iron sheet which comprises the steps of (a) providing a fine grained primary-recrystallized silicon-iron sheet containing 2.2 to 4.5 percent silicon, between about three and 50 parts per million boron, and between about 15 and 95 parts per million nitrogen in the ratio to boron of one to 15 parts per part of boron, (b) electrolyzing an aqueous electrolytic solution consisting essentially of calcium formate and boric acid buffered with solid $Ca(BO_2)_2$ with said silicon-iron sheet being arranged as the cathode in said solution, thereby covering the sheet with an adherent electrically insulating coating of $Ca(BO_2)_2$ to form a $Ca(BO_2)_2$-coated sheet, said solution being maintained at a temperature of at least about 65° C. throughout its period of electrolytic deposition, (c) electrolyzing an aqueous electrolytic solution consisting essentially of solid magnesia-buffered magnesium formate with said $Ca(BO_2)_2$-coated sheet arranged as the cathode in said magnesium formate solution, thereby covering the $Ca(BO_2)_2$ coating with a substantially thicker electrically insulating coating of $Mg(OH)_2$ to form a double-coated sheet, said magnesium formate solution being maintained at a temperature of at least 65° C. throughout its period of electrolytic deposition and (d) thereafter subjecting said double-coated sheet to a final heat treatment to develop (110)[001] secondary recrystallization texture in the silicon-iron sheet.

2. The method of claim 1 in which the boron content of the silicon-iron sheet is between about 10 and 30 parts per million.

3. The method of claim 1 in which the boron content of the silicon-iron sheet is about 10 parts per million and the nitrogen content of the said sheet is about 30 parts per million.

4. The method of claim 1 in which each electrolytic solution is maintained at a temperature between about 90° and 95° C. during its period of electrolytic deposition.

5. The method of claim 1 in which the electrically insulating $Ca(BO_2)_2$ coating is about 0.02 to 0.07 mil thick and the electrically insulating $Mg(OH)_2$ coating is about 0.10 to 0.18 mil thick.

6. The method of claim 5 in which the total thickness of said electrically insulating coatings is between about 0.10 and 0.40 mil thick.

7. The method of claim 6 in which the total thickness of said electrically insulating coatings is about 0.20 mil.

8. The grain-oriented silicon-iron sheet product of the process of claim 1.

9. A double-coated primary-recrystallized silicon-iron sheet prepared by the process steps of (a) providing a fine grained primary-recrystallized silicon-iron sheet containing 2.2 to 4.5 percent silicon, between about three and 50 parts per million boron, and between about 15 and 95 parts per million nitrogen in the ratio to boron of one to 15 parts per part of boron, (b) electrolyzing an aqueous electrolytic solution consisting essentially of calcium format and boric acid buffered with solid $Ca(BO_2)_2$ with said silicon-iron sheet being arranged as the cathode in said solution, thereby covering the sheet with an adherent electrically insulating coating of $Ca(BO_2)_2$ to form a $Ca(BO_2)_2$-coated sheet, said solution being maintained at a temperature of at least about 65° C. throughout its period of electrolytic deposition, and (c) electrolyzing an aqueous electrolytic solution consisting essentially of solid magnesia-buffered magnesium formate with said $Ca(Bo_2)_2$-coated sheet arranged as the cathode in said magnesium formate solution, thereby covering the $Ca(BO_2)_2$ coating with a substantially thicker electrically insulating coating of $Mg(OH)_2$ to form the double-coated primary recrystallized silicon-iron sheet, said magnesium formate solution being maintained at a temperature of at least 65° C. throughout its period of electrolytic deposition, , said double-coated silicon-iron sheet being characterized with a capability of undergoing a significantly decreased extent of carburization during heat treatment thereof to develop (110)[001] secondary recrystallization texture in the sheet relative to the extent of carburization which a reference double-coated silicon-iron sheet undergoes during said heat treatment, said reference sheet having been prepared by said process steps except substituting calcium acetate for calcium formate in step (c) in an amount of calcium acetate which is equimolar with respect to the amount of calcium formate employed in said step (c).

* * * * *